US007695322B2

(12) United States Patent
Clyatt

(10) Patent No.: US 7,695,322 B2
(45) Date of Patent: Apr. 13, 2010

(54) COAXIAL CONNECTOR

(75) Inventor: Clarence L. Clyatt, Tempe, AZ (US)

(73) Assignee: Southwest Microwave, Inc. Arizona Corporation, Tempe, AZ (US)

( * ) Notice: Subject to any disclaimer, the term of this patent is extended or adjusted under 35 U.S.C. 154(b) by 349 days.

(21) Appl. No.: 11/787,873

(22) Filed: Apr. 17, 2007

(65) Prior Publication Data

US 2009/0203257 A1 Aug. 13, 2009

Related U.S. Application Data

(60) Provisional application No. 60/813,209, filed on Jun. 12, 2006.

(51) Int. Cl.
*H01R 24/00* (2006.01)

(52) U.S. Cl. ..... 439/675; 439/578

(58) Field of Classification Search ..... 439/675, 439/578

See application file for complete search history.

(56) References Cited

U.S. PATENT DOCUMENTS 3,154,360 A * 10/1964 Plishner ..... 439/335
3,302,159 A * 1/1967 Schumacher ..... 439/620.21
3,416,125 A * 12/1968 Theve ..... 439/638
4,336,974 A * 6/1982 Wilson ..... 439/13
4,545,633 A * 10/1985 McGeary ..... 439/141
5,067,906 A * 11/1991 Woodgate ..... 439/115
5,576,675 A 11/1996 Oldfield
5,704,809 A 1/1998 Davis
5,879,188 A 3/1999 Clyatt, III
6,174,206 B1 * 1/2001 Yentile et al. ..... 439/638
6,210,221 B1 4/2001 Maury
6,350,155 B1 * 2/2002 Mullinger-Bausch et al. .... 439/675
6,666,725 B2 12/2003 Botka et al.

* cited by examiner

*Primary Examiner*—Gary F. Paumen
(74) *Attorney, Agent, or Firm*—Gregory J. Nelson

(57) ABSTRACT

A subminiature coaxial connector including a matched impedance plug and jack for coupling printed circuit boards, RF modules, coaxial cables, and the like, and minimizing RF or microwave signal losses and/or degradations. The plug and jack each comprises a coaxial structure including an outer tubular conductor and a center contact held in place by a dielectric sleeve within the outer tubular conductor. The geometries of these elements are such that when the plug and jack are fully joined, the elements are coextensive and butt-mated, without steps, gaps, or other discontinuities. By combining structural functions into the electrical conductors, the present invention allows for fewer parts and shorter mating distances than is available in the prior art. Despite the small Size 20 connectors that are achievable with the present invention, low voltage standing wave ratios (VSWR's) can still be observed through 67 GHz, with theoretical cutoff frequencies in excess of 100 GHz.

18 Claims, 6 Drawing Sheets

14

16

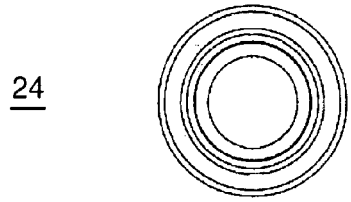
FIG. 13B.
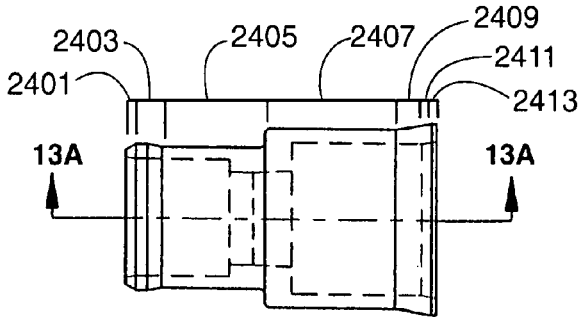
FIG. 13.
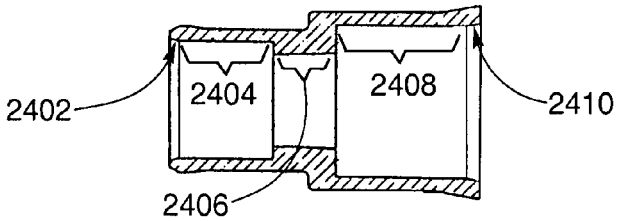
FIG. 13A.
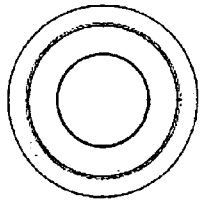
FIG. 13C.
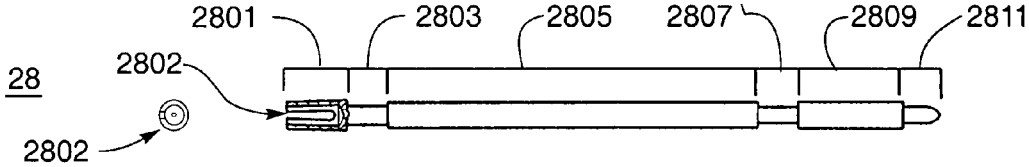
FIG.14A.
FIG. 14.
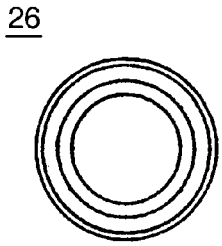
FIG. 15.B.
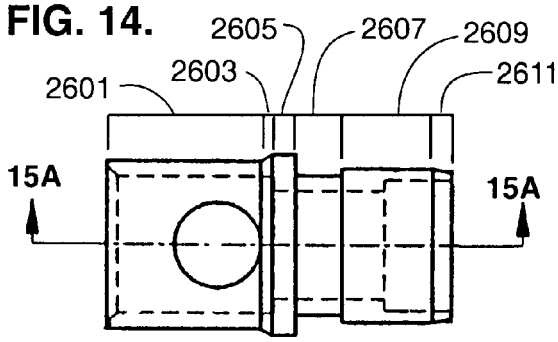
FIG. 15.
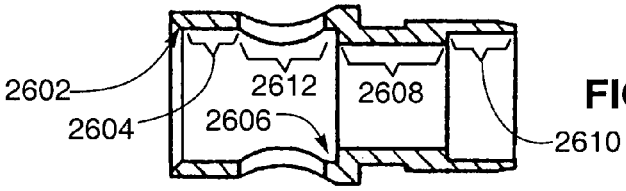
FIG. 15A.

COAXIAL CONNECTOR

CROSS-REFERENCE TO RELATED APPLICATION IS MADE

This application is based on U.S. Provisional Patent Application Ser. No. 60/813,209, filed Jun. 12, 2006, of the same title.

FIELD OF THE INVENTION

The present invention relates generally to millimeter wave and microwave connectors and more particularly to subminiature, high performance, blind-mate, matched impedance millimeter wave and microwave connectors for applications such as releasably coupling printed circuit boards; flexible and semirigid coaxial cables; and for use as insertable/removable contacts in standard signal and power contact cavities as small as size 20, such as in commercial, industrial and MIL-SPEC multi-contact connector standard contact arrangements.

BACKGROUND OF THE INVENTION

A microwave and millimeter wave connector, sometimes called a coaxial connector, is that part of an electrical signal transmission system which allows for the coupling and uncoupling of system-interconnecting conductors forming part of printed circuit boards (PCBs), radio frequency (RF) modules, coaxial cables, and so forth.

Typical blind-mate millimeter wave and microwave coaxial connectors have an outer contact with spring fingers that are protected by an alignment hood. In some prior art designs, an alignment hood acts as the outer contact for the jack, where the alignment hood does not itself have spring fingers, which in turn requires that the plug have spring fingers on its outer contact. These spring fingers are unprotected and therefore susceptible to damage, and also become a source for electromagnetic interference (EMI) leakage in such prior art connectors. EMI leakage is minimized by virtue of several design qualities in the present invention, including an outer sleeve on the jack that fully encloses the jack's outer contact spring fingers without increasing the outer diameter of the overall assembly. The jack's outer contact is mated to the solid tube of the plug's outer contact, the solid (as opposed to slotted) plug outer contact, and the jack's solid (not slotted) front alignment bushing. Further background information for the present invention is incorporated by reference to U.S. Pat. No. 5,879,188.

BRIEF SUMMARY OF THE INVENTION

The present invention relates to millimeter wave and microwave coaxial connectors. The invention is applicable to a wide range of uses including but not limited to standard commercial and MIL-SPEC multi-contact connectors for industrial, medical, military and aerospace use. The present invention may be applied, for example, to produce coaxial connectors as small as non-coaxial Size 20 under the MIL-C-38999, MIL-C-26500, and ARINC 600 specifications, or, by further example, Size 20 HD under the MIL-C-24308 specification. The present invention is designed to accommodate the envelopes prescribed by MIL-C-39029, which defines contact envelopes used in most multi-contact connectors. In addition to multi-contact connectors, the invention can be applied to discrete, panel-mount, or snap-together cable-to-cable applications. Although initial design are to serve commercial applications, industry standard specifications, including MIL-SPECS, are used for design reference. The useful frequencies for the invention range from approximately 10 GHz as a minimum to over 67 GHz as a maximum while maintaining low voltage standing wave ratio (VSWR), and with 110 GHz theoretical cutoff frequency.

Though not required, it is an object of the invention that contact assemblies comprised of coaxial connectors that are the subject of the invention, or said coaxial connectors in combination with prior art connectors, be insertable and removable using standard insertion and extraction tools for a given connector.

The invention uses 3-stage sequential alignment to assure proper outer and center contact engagement while making for a short interface engagement length. The jack has an internal spring that compensates for tolerance stack-up and ensures that all coaxes in any multi-contact and multi-connector arrangement are butt-mated when the host connectors are fully mated. Air is the predominant dielectric over the length of the connector assembly, which allows for a small inner diameter (ID) for the outer contact and large outer diameter (OD) for the center contact. Using air as the primary dielectric also reduces or eliminates impedance matching variables in the assembly due to the reduction of material property and dimensional variations inherent with any solid dielectric material. The center contacts in both the plug and the jack are rigidly retained within each subassembly to assure proper performance and durability. The shape and material properties of the two small dielectric beads in both the jack and plug subassemblies allow for a center contact retention force much stronger than what is typical in the prior art.

The plug's outer conductor is a tube that protrudes from the face of the host connector plug insulator, when used in such an application, such that there are no exposed slotted beams to be damaged or broken, or to cause significant signal losses across the junction. The plug center contact has a single slot rather than multiple beams, resulting in approximately 300° or greater of circumferential contact with the mating pin.

A preloaded internal spring, located in the jack, assures that each millimeter wave and microwave coax interface is maintained in a butt-mated condition in all operating conditions when the connector is properly mated. The outer sleeve of the jack houses the integral spring in one embodiment, and can incorporate a guide bushing for redundant alignment purposes in addition to full enclosure of the jack's outer contact spring fingers without increasing the outer diameter of the assembly, while minimizing EMI leakage.

The above-listed qualities result in a connector having an effective maximum operating temperature of +165° C. with stable voltage standing wave ratio (VSWR) and insertion loss (IL) performance from −55° C. to +165° C. Furthermore, because more data can be transmitted through a small connector than was previously possible, system-level reliability is improved for multi-connector interfaces where fewer connectors are required. Finally, the use of field-replaceable flange mounts and thread-in plugs and jacks allows for reduced service time in the event of a failure.

BRIEF DESCRIPTION OF THE DRAWINGS

The above and other advantages and objects of the present invention will become more apparent from the following description, claims and drawings in which:

FIG. 13 is a side view of the jack rear housing;

FIG. 13A is a cutaway view of the jack rear housing;

FIG. 13B is an axial end view of the jack rear housing;

FIG. 13C is an axial end view of the jack rear housing;

FIG. 14 is a side view of the jack center contact;

FIG. 14A is an axial end view of the jack center contact;

FIG. 15 is a side view of the jack cable bushing;

FIG. 15A is a cutaway view of the jack cable bushing; and

FIG. 15B is an axial end view of the jack cable bushing;

DETAILED DESCRIPTION OF THE DRAWINGS

Jack Assembly

FIG. 1

Figure 1:
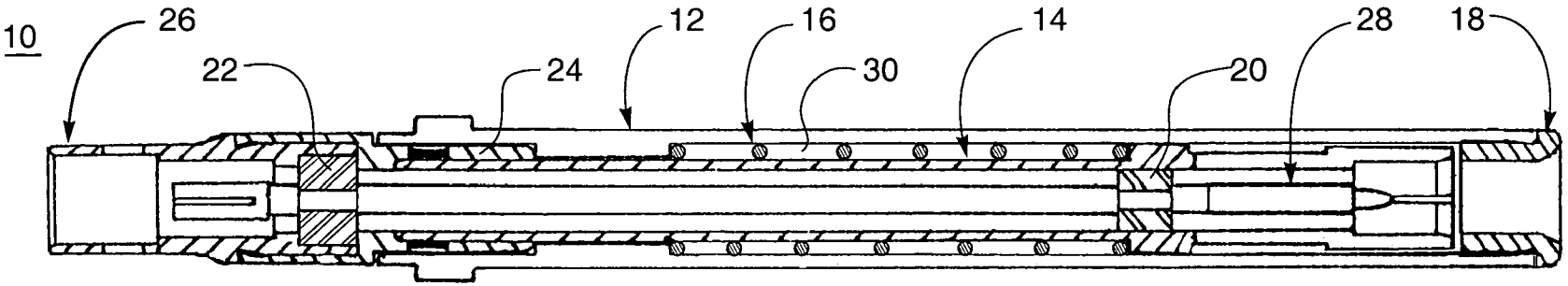
FIG. 1 is a cutaway view of the main components of a coaxial jack according to a preferred embodiment of the invention.

Turning now to the drawings, beginning with FIG. 1, a coaxial jack assembly 10 is shown according to a preferred embodiment. The outer sleeve 12 houses most of the individual components of which the jack assembly 10 is comprised. An alignment bushing 18 is mounted by swaging or is otherwise attached to the front of the outer sleeve 12. The alignment bushing 18 serves as the initial contact surface when the jack 10 and plug 50 (FIG. 2) are brought together for mating. Spring fingers 1412 of the outer contact 14 are the first features encountered past the alignment bushing 18 and these spring fingers 1412 serve as the mating region for the jack assembly 10.

Moving further inward, a contact pin 28 is a conductor, depicted here as solid, that is substantially concentric with the outer contact 14 and outer sleeve 12 and serves as the inner conductor for the coaxial connection. The contact pin 28 is mounted in two insulators: a front bead ring 20 and a rear bead ring 22, each of which takes the form of a hollow cylinder in this preferred embodiment. In this embodiment of the jack assembly 10, an air gap 30 serves as the primary dielectric between the contact pin 28 and the outer contact 14.

A coil spring 16 that is concentric with the outer sleeve 12, outer contact 14, and contact pin 28, is contained, in a state of compression, within a gap 32 between the outer surface of the outer contact 14 and the inner surface of the outer sleeve 12. The spring 16 pushes the outer contact 14 to the forward limit of its travel within the outer sleeve 12 when the plug 50 (see FIG. 2) is disengaged. When the plug 50 is inserted into the jack 10, the spring 16 is further compressed by movement of the outer contact 14 within the outer sleeve 12. The details of this engagement between jack 10 and plug 50, as well as further details on the interaction of individual components, are further explained in the other Figures.

Near the rear of the jack 10 is a rear housing 24 which is pressed and soldered, or is otherwise physically attached to the outer contact 14. In the embodiment illustrated, the outer sleeve 12 is in electrical contact with the outer contact 14 via sliding contact points, but said electrical connection is not necessarily advantageous to the operation of the coaxial connection.

A cable bushing 26 is press fit and swaged inside, or is otherwise attached to, the rear housing 24 where the cable bushing 26 contains the rear bead ring 22 and therefore also contains the back portion of the contact pin 28. The cable bushing 26 serves as the interface between the jack 10 and a cable or other transmission device (not shown) which terminates at the jack 10.

Plug Assembly

FIG. 2

Figure 2:
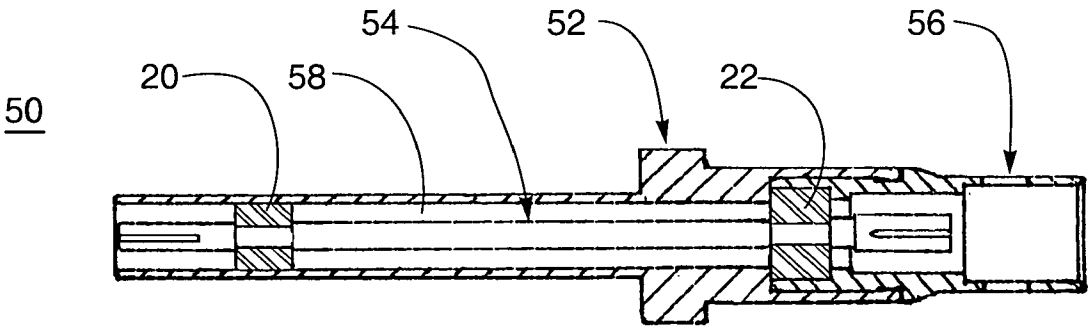
FIG. 2 is a cutaway view of the main components of a coaxial plug according to a preferred embodiment of the invention.
Figure 3A:
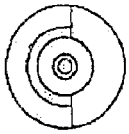
FIG. 3A is an axial end view of the preferred embodiment in FIG. 3.
Figure 3:
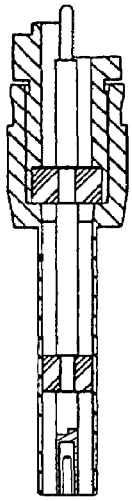
FIG. 3 is a cutaway view of the main components of a coaxial plug according to another preferred embodiment of the invention.

Referring now to FIG. 2, a plug assembly 50 is shown according to a preferred embodiment. The plug's outer contact 52 constitutes the outer surface of the plug assembly 50 for much of the plug assembly's length. Moving further inward, a contact pin 54 is depicted as a solid conductor that is substantially concentric with the outer contact 52 and serves as the inner conductor for the microwave connection.

The contact pin 54 is mounted in two dielectric insulators: a front bead ring 20 and a rear bead ring 22, each of which takes the form of a hollow cylinder in this preferred embodiment. In this embodiment of the plug assembly 50, an air gap 58 serves as the primary dielectric between the contact pin 54 and the outer contact 52.

Near the rear of the plug 50 is a cable bushing 56 which is swaged or otherwise attached to the outer contact 52. The cable bushing 56 facilitates connection between the plug assembly 50 and a coaxial cable (not shown).

FIG. 3

Alternate Plug Views

Omitted

Plug Outer Contact

FIG. 4

The outer contact 52 generally takes the form of a hollow cylinder having various steps and chamfers, both internal and external, that are designed to interface with the bushing 56 and to minimize internal reflections and EMI leakage from the connector. The dimensional features noted are intended to be circumferentially constant such that any cross section taken longitudinally and passing through the longitudinal axis, such as Line 4A, will result in identical halves as in FIG. 4A.

Figure 4B:
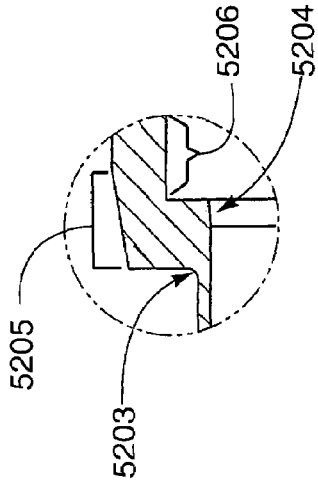
FIG. 4B is an enlarged view of the marked portion of the plug outer housing as depicted in FIG. 4A.
Figure 4C:
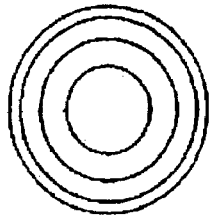
FIG. 4C is an axial end view of the plug outer housing.
Figure 4:
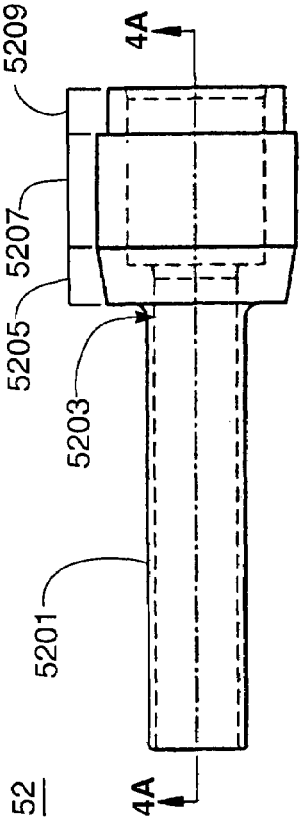
FIG. 4 is a side view of the plug outer housing.
Figure 11:
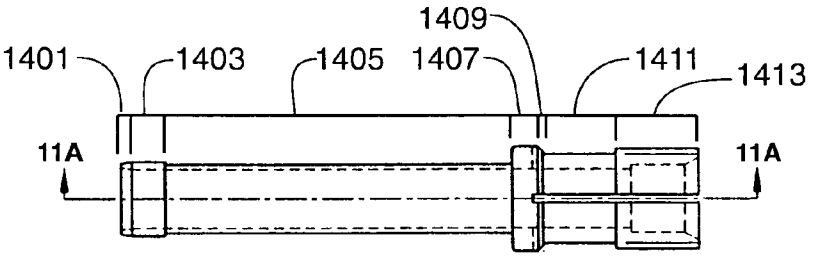
FIG. 11 is a side view of the jack outer contact.
Figure 11B:
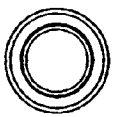
FIG. 11B is an axial end view of the jack outer contact.
Figure 11A:
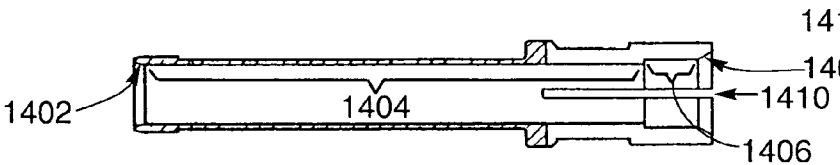
FIG. 11A is a cutaway view of the jack outer contact.

Beginning at the left end of FIG. 4, a constant-diameter hollow tube section 5201 has an OD that is slightly smaller than the ID of the alignment bushing 18 on the jack to facilitate mating with the slotted region 1410 of the jack's outer contact 14 (see FIG. 11A). When fully mated, the hollow tube section 5201 makes contact with the full length of the slotted ID 1406 of the jack's outer contact 14. After the constant-diameter hollow tube section 5201 is a fillet transition 5203 to a larger-diameter hollow cylinder region 5205 having a beveled OD that increases in diameter at it approaches the next region, 5207. The larger-diameter region 5205 serves as an absolute stop when the jack 10 and plug 50 are forced together to the maximum extent possible, against the axial compression force of the spring 16, by making contact with the jack's alignment bushing 18. The next constant-diameter region 5207 need not be a separate region at all, but simply serves to provide an appropriate wall thickness between the inner 5206 and outer 5207 diameters for the strength needed to rigidly retain the bushing 57 inside. The right-most outer region in the Figure, 5209, need not be a reduced diameter from the region 5207, but is shown in that configuration here as it would provide an appropriate wall thickness for a swaging process during assembly with the bushing 57.

Figure 4A:
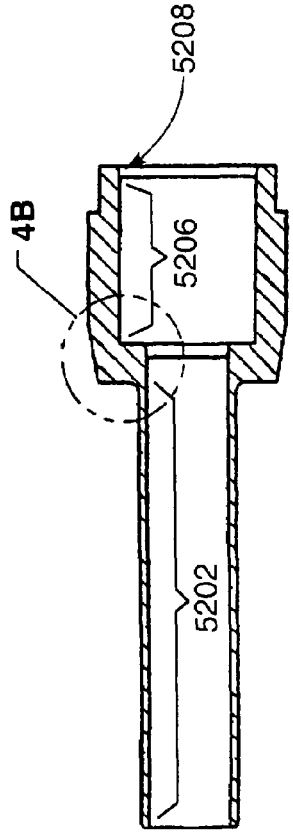
FIG. 4A is a cutaway side view of the plug outer housing.

In FIG. 4A, a cross section view taken along Line 4A in FIG. 4, the features along the ID of the outer contact 52 are readily shown. The constant-diameter region 5202 corresponds to the constant-diameter thin hollow tube region 5201 of the OD and provides an interference fit for the front bead ring 20 shown in FIG. 2. A small beveled section 5204 (see also FIG. 4B) transitions between the small diameter region 5201 and large diameter region 5206. The beveled sections 5204 facilitates insertion of the front bead ring. The large diameter region 5206 is slightly larger in ID than the OD of the bushing 56 which is inserted and typically swaged into the large diameter region 5206 of the outer contact 52 during assembly.

The plug's outer contact 52 serves to house the front bead ring 20, the cable, end-launch, or other bushing 56 that in turn holds the rear bead ring 22, and the center contact pin 54 that is held in place by the bead rings 52, 22. The outer contact 52 is swaged or otherwise attached to the bushing 56. The outer contact 52 can be made of Beryllium Copper Alloy UNS-C17300, temper TD04 or TD02 per ASTM-B-196/197, or any suitable metal having high conductivity, good machining traits, and which is heat treatable and easily plated.

Plug Center Contact

FIG. 5

Figures 5, 5A:
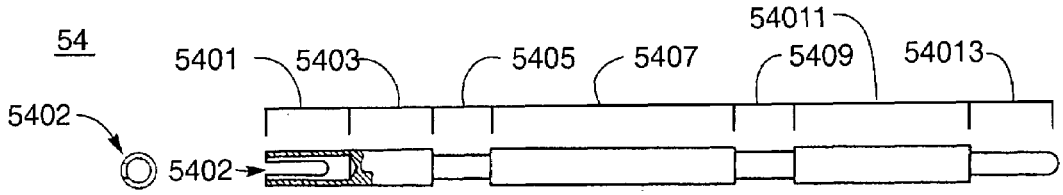
FIG. 5 is a side view of the plug center contact.
FIG. 5A is an axial end view of the plug center contact.

FIG. 5 illustrates one possible plug center contact pin 54, shown here in a configuration used for "end-launch" PC board application. The pin 54 is shown here as a solid cylinder having three stepped-down regions (5405, 5409, 5413) and a slotted and hollowed end region 5401. First, the stepped-down rear end 5413 is typically used when connecting with a PC board. This rear stepped down region's 5413 diameter is dictated by the application, and the rounded tip 5404 eases assembly into the corresponding connector. Note that in the case of some connection applications, the rear end 5413 would instead have a similar configuration to the hollow front end 5401 (see FIG. 2 for an illustration of this concept), instead of the solid end shown.

Another stepped-down region 5409 is designed to have the rear bead 22 snapped into place at that location. Thus the length and diameter of the stepped-down region 5409 are substantially the same as the ID 222 and thickness 223 of the rear bead 22 (see FIG. 7). Likewise, the final step down region 5405 is intended to have the front bead 20 snapped into place at that location, where the length and diameter of the stepped-down region 5405 correspond to the ID 202 and thickness 203 of the front bead 20 (see FIG. 6).

The front end 5401 is hollowed with an ID slightly larger than the front end 2811 of the jack's center contact 28 where said front end 5401 of the plug's center contact has a single slot 5402 cut longitudinally in the hollow cylinder wall. The hollow cylindrical shape of the front end 5401 may be crimped slightly radially to provide increased frictional retention of the front end 2811 when these components are assembled.

The contact pin 54 can be made of Beryllium Copper Alloy UNS-C17300, temper TD04 or TD02 per ASTM-B-196/197, or any suitable metal having high conductivity, good machining traits, and which is heat treatable and easily plated.

Rear Bead

FIG. 6

Figures 6, 6A:
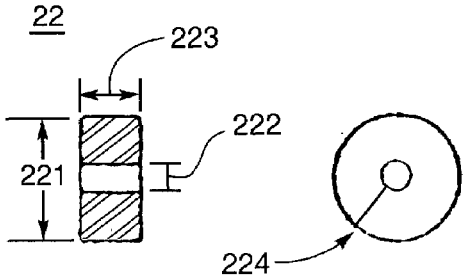
FIG. 6 is a front view of the rear bead.
FIG. 6A is a cutaway view of the rear bead.

FIGS. 6 & 6A illustrate the rear bead ring 22, which takes the form of a hollow cylinder having an approximately constant cross-section. In FIG. 6 there is visible a radial slit 223 that is cut from the ID 222 to the OD 221 and through the entire thickness 224 of the rear bead 22. The rear bead ring's OD 221 is slightly larger than the bushing's ID 572, 2610 to provide an interference fit, and the rear bead ring's thickness 223 is substantially the same as the depth of the bushing's ID 572, 2610 and length of the corresponding center contact's stepped-down region 543, 2803. The rear bead ring's ID 222 is substantially the same as the diameter of the corresponding center contact's stepped-down region 543, 2803.

The rear bead ring 22 is press-fit onto the center contact 54, 28 in the respective stepped-down region 543, 2803. The rear bead ring 22 is manufactured with one radial slit through the cylinder wall, from which no material is removed, to facilitate assembling the rear bead ring 22 onto the center contact 54, 28.

The rear bead ring 22 can be made of ULTEM® polyetherimide or any material that has suitably low dielectric constant and high yield strength across various temperatures, frequencies, and manufacturing lots, steady state high temperature operating capability, toughness, and good machinability or moldability.

Front Bead

FIGS. 7, 7A

Figures 7, 7A:
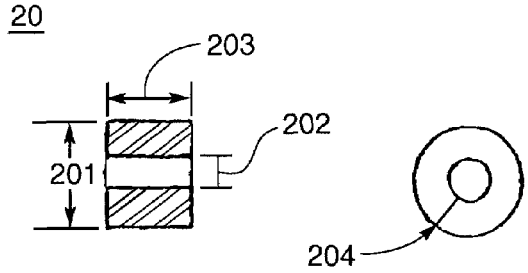
FIG. 7 is a front view of the front bead.
FIG. 7A is a cutaway view of the front bead.

FIGS. 7 & 7A illustrate the front bead ring 20, which takes the form of a hollow cylinder having an approximately constant cross-section. In FIG. 7 there is visible a radial slit 204 that is cut from the ID 202 to the OD 201 and through the entire thickness 203 of the front bead 20. The front bead ring's OD 201 is slightly larger than the jack outer contact's ID 1404 and the plug outer contact's ID 5201 to provide an interference fit, and the front bead ring's thickness 203 is substantially the same as the length of the corresponding center contact's stepped-down region 541, 2807. The front bead ring's ID 202 is substantially the same as the diameter of the corresponding center contact's stepped-down region 541, 2807.

The front bead ring 20 can be made of KEL-F® polychlorotrifluoroethylene or any material that has suitably low dielectric constant and high yield strength across various temperatures, frequencies, and manufacturing lots, steady state high temperature operating capability, toughness, and good machinability or moldability. The front bead ring 20 is press-fit onto the center contact 54, 28 in the corresponding stepped-down region 541, 2807. The front bead ring 20 is manufactured with one radial slit through the cylinder wall, from which no material is removed, to facilitate assembling the front bead ring 20 onto the center contact 54, 28. The front bead ring 20 and the rear bead ring 22 may be produced using the same materials if properly designed for electrical and mechanical results.

Plug Cable Bushing

FIG. 8

Figure 8:
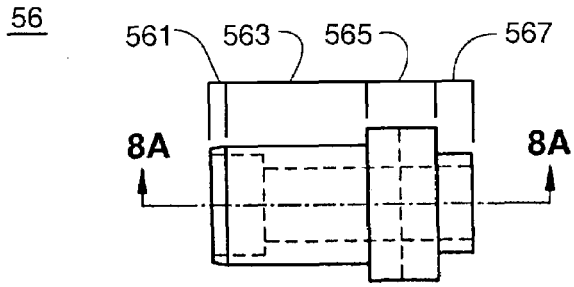
FIG. 8 is a side view of a bushing that can be used when the coaxial connector is connected to a PC board mount rather than to a cable.

FIG. 8 illustrates the plug's bushing 56, which takes the shape of a hollow cylinder having varying inner and outer diameter dimensions that are circumferentially constant. That is, any longitudinal section taken through the longitudinal axis, such as through Line 8A in FIG. 8, will result in identical halves as illustrated in FIG. 8A.

Figure 8A:
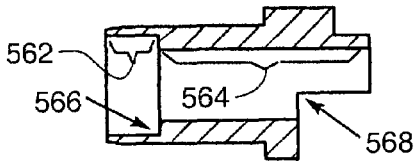
FIG. 8A is a cutaway view of the bushing shown in FIG. 8.
Figure 8B:
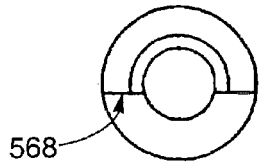
FIG. 8B is an end view of the bushing shown in FIG. 8.

The bushing illustrated in FIGS. 8, 8A, & 8B is intended for a PC board application where a cutout region 568 is used to fit the PC board end-launch connector (not shown). Several notable features exist along the OD of the bushing 56. Starting on the left, a beveled or chamfer region 561 at the end simply facilitates assembly of the bushing 56 into the plug's outer contact 52, or the jack's rear housing 24. Next, the constant-diameter region 563 is sized to maximize contact with the ID 5206 of the plug's outer contact 52 or the ID 2408 of the jack's rear housing 24 when the components are fully assembled. The larger diameter section 565 that follows is shown with constant diameter, though it need not be constant. This section 565 acts as a stop when the bushing 56 is assembled into the plug's outer contact 52 or the jack's rear housing 24. The remaining narrow region 567 is shaped to accommodate an end-launch connector, a coaxial cable, or other application (not shown).

Along the ID, the large ID region 562 at left is sized to form an interference fit with the rear bead ring 22, which is press-fit into the ID region 562 up to the full depth that ends at a neck-down region 566.

The bushing 56 holds the rear bead ring 22 that in turn holds the center contact 54 in position. The cable bushing 56 is press fit into the front housing 52 and swaged or otherwise fixed into place. When assembled into the plug assembly 50, the cable bushing 56 constitutes the rearmost extremity of the plug assembly 50 and connects to a coaxial cable (not shown). The front end of the cable bushing 56 has the same dimensional configuration as bushings designed for other applications such as the aforementioned PCB end-launch bushing.

The cable bushing 56 can be made of Beryllium Copper Alloy UNS-C17300, temper TD04 or TD02 per ASTM-B-196/197, or any suitable metal having high conductivity, good machining traits, and which is heat treatable and easily plated.

Jack Outer Sleeve

FIG. 9

FIGS. 9, 9A, 9B, & 9C illustrate the jack outer sleeve 12. The jack outer sleeve 12 houses and protects most of the components that comprise the jack assembly 10 (see FIG. 1). Like most of the coaxial connector components, the shape of the sleeve 12 takes the form of a hollow cylinder having varied inner and outer diameters such that it is circumferentially constant. That is, any cross section taken parallel to the sleeve's longitudinal axis, such as Line 9A in FIG. 9, will result in a symmetrical section shape. An end-view, FIG. 9C, demonstrates the concentric features of the hollow cylinder that comprises the jack outer sleeve 12.

Figure 9:
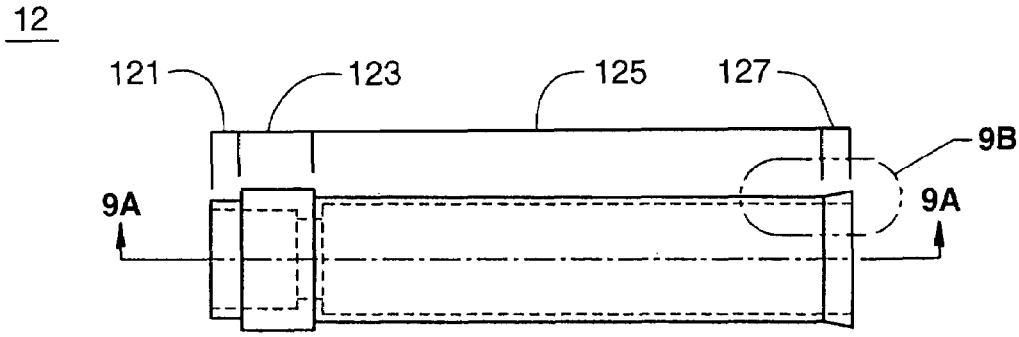
FIG. 9 is a side view of the jack outer sleeve.
Figure 9C:
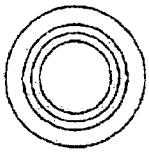
FIG. 9C is an axial end view of the jack outer sleeve.

The various steps, bevels, and chamfers mainly serve the purpose of accommodating other jack components. In FIG. 9, the rear OD region 121 approximately matches the OD region 2409 on the jack's rear housing 24 for packaging reasons. The larger OD region 123 is likewise not critical to functionality, but provides extra material and strength in the region of the jack's outer sleeve 12 where it can be soldered to the rear housing 24. The long, thin-walled, tubular region 125 is shown here with constant OD, though the OD could be given different features to accommodate packaging needs. The flared region 127 shown in detail in FIG. 9B adds material to the front end of the sleeve 12 to facilitate a swaging operation used to retain the alignment bushing 18 during assembly, but is not otherwise critical to the function of the connector. Likewise, the small, constant-OD region 29 at the front of the sleeve 12 is intended to break the otherwise sharp edge.

Figure 9A:
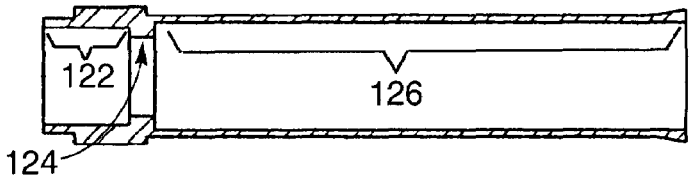
FIG. 9A is a cutaway view of the jack outer sleeve.
Figure 9B:
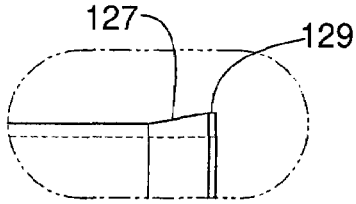
FIG. 9B is an enlarged detail view of one portion of the jack outer sleeve.

Turning to the inside of the jack's outer sleeve 12, best illustrated in FIG. 9A, the rear ID region 122 is sized to accommodate the OD regions 2407, 2409, 2411, 2413 of the rear housing 24 for assembly and soldering. The narrowed ID region 124 both limits the depth that the rear housing 24 can travel during assembly, and constrains the position of the spring's squared end 1601. The long, constant-ID region 126 of the sleeve 12 serves to constrain the position of the spring 16 in all axial directions, and is sized to allow the front housing 14 to slide axially, under variable axial loads imparted by the spring 16 and the plug 50, and furthermore, allows for insertion of the alignment bushing 18 into the front end of the sleeve 12 during assembly. The jack's outer sleeve 12 can be made of tempered steel alloy UNS-S30300, temper A per ASTM-A582, or any suitable metal that is high strength and is heat treatable.

Jack Alignment Bushing

FIG. 10

Figure 10:
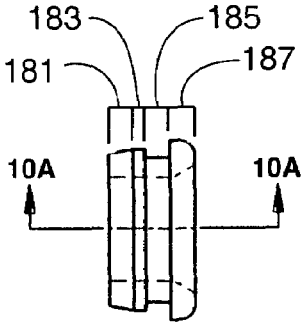
FIG. 10 is a side view of the jack alignment bushing.
Figure 10B:
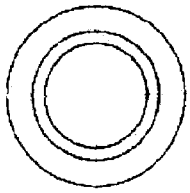
FIG. 10B is an axial end view of the jack alignment bushing.
Figure 10A:
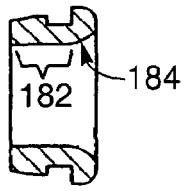
FIG. 10A is a cutaway view of the jack alignment bushing.

FIGS. 10, 10A, & 10B illustrate the alignment bushing 18 that can be used to enhance the durability of the jack 10 and aid in properly aligning the jack 10 with the plug 50 during mating. The alignment bushing 18 serves as the first point of contact on the jack 10, when it is brought together with the plug 50 for mating. The alignment bushing 18 takes the form of a hollow cylinder having variable ID and OD along its axial length such that it is circumferentially constant. That is, any cross section taken parallel to and through the bushing's longitudinal axis, such as Line 10A in FIG. 10, will result in a symmetrical cross section shape. An end-view, FIG. 10B, illustrates the concentric features of the hollow cylinder that forms the alignment bushing 18. The aforementioned diameter variations form features that interface with the outer sleeve 12 during assembly and facilitate alignment of the jack 10 and plug 50 during the mating process.

Starting with the features on the OD, a beveled region 181 is used to ease assembly of the alignment bushing 18 into the front end of the jack's outer sleeve 12. Following the beveled region 181 is a constant-OD region 183 that has approximately the same OD dimension as the ID region 126 of the jack's outer sleeve 12 to provide a snug fit during assembly. A narrow-OD region 185 follows, which provides room for the flared region 127, 129 of the outer sleeve 12 for swaging or otherwise retaining the alignment bushing 18. The large OD region 187 at the front of the alignment bushing 18 has approximately the same maximum OD as the OD 125 of the jack's outer sleeve 12 and is rounded off to break the edge.

FIG. 10A best illustrates the ID features of the alignment bushing 12. A constant-ID region 182 has approximately the same ID dimension as the ID region 1406 of the jack's outer contact 14 (see FIG. 11A). The constant-ID region 182 guides and aligns the plug's outer contact 52 during the initial stages of mating the connectors, and guides the plug's outer contact 52 into the jack's outer contact 14. A rounded or beveled region 184 provides the initial guidance at the start of mating the connectors by redirecting any significant misalignment of the plug 50 towards the central longitudinal axis of the jack 10.

FIG. 10B illustrates a front end view of the alignment bushing 18, demonstrating the concentricity of its various features. The alignment bushing 18 can be made of Beryllium Copper Alloy UNS-C17300, temper TD04 or TD02 per ASTM-B-196/197, or any suitable metal having high conductivity, good machining traits, and which is heat treatable and easily plated.

Jack Outer Contact

FIG. 11

Figure 11C:
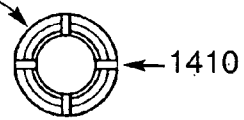
FIG. 11C is an axial end view of the jack outer contact.

FIGS. 11, 11A, 11B, & 11C illustrate the jack's outer contact 14. The jack's outer contact 14 takes the form of a hollow cylinder having varying inner diameter and outer diameter along its axial length such that it is circumferentially constant through most, but not all, of its length. A cross section taken parallel to the sleeve's longitudinal axis will result in a symmetrical cross section shape, except in the front region where longitudinal slots 1410 create spring fingers 1412 in that region. An end-view, FIG. 11C, illustrates the concentric features of the hollow cylinder that comprises the front end of the jack's outer contact 14. Similarly, another end view, FIG. 11B, illustrates the concentric features of the hollow cylinder that comprises the rear end of the jack's outer contact 14. The shape of the outer contact 14 generally takes the form of a hollow cylinder having varied inner and outer diameters such that it is circumferentially constant except where spring fingers 1412 are cut. The various dimensional features, including diameter changes and chamfers, serve to accommodate other components of the jack assembly, to align the critical components during the mating process, and to maximize contact surface area between the outer contacts 14, 52 when the plug 50 and jack 10 are mated.

Beginning with the OD features of the jack's outer contact 14 as illustrated in FIG. 11, a beveled region 1401 is used to aid insertion of the outer contact 14 into the rear housing 24 during assembly. A medium-diameter OD region 1403 has approximately the same OD dimension as the ID dimension 2404 of the jack rear housing 24, which provides a tight fit when these components are assembled together. A constant-diameter section 1405 follows and has approximately the same OD dimension as ID region 124 of the outer sleeve 12. This constant-diameter region 1405 has a slightly smaller OD dimension than the ID dimension 162 of the spring 16, enabling the spring 16 to slide freely over the surface of the constant-diameter region 1405 during the mating operation. A large-diameter OD region 1407 serves to constrain the spring 16 axially and has a dimension slightly smaller than the ID region 126 of the outer sleeve 12, with which the large diameter OD region 1407 of the outer contact 14 is in sliding contact. A beveled region 1409 transitions the large diameter region 1407 to a medium-diameter OD region 1411. This medium-diameter OD region 1411 approximately marks the rear extremity of the spring fingers 1412 (see FIG. 11C) and is intended to have a wall thickness that provides adequate strength for the spring fingers 1412. A larger-diameter region 1413 follows, and is intended to maintain the strength of the spring fingers 1412 where their ID 1406, 1408 expands to its maxima.

Turning now to FIG. 11A, the inner features of the outer contact 14 are best illustrated. A chamfered region 1402 is located at the rear extremity of the outer contact 14, which eases insertion of the front bead ring 20 during the assembly process. A constant-diameter ID region 1404 defines the outer boundary of a dielectric air gap 30 (see FIG. 1) and is slightly smaller than the OD 201 of the front bead ring 20 in order to provide an interference fit. A slightly-larger diameter ID region 1406 is sized to accept the OD 5201 of the plug's outer contact 52 during the mating process, through an interference fit. Finally, a chamfered region 1408 provides an alignment aid when the outer contacts 14, 52 first come into contact with one another during the mating process.

The aforementioned spring fingers 1412 are best illustrated in FIGS. 11A and 11C, where four are shown in this preferred embodiment. The exact number of spring fingers 1412 used can be varied, but does affect the signal quality. While two or more spring fingers will function, performance is enhanced as the spring fingers more closely approximate a circle when the plug is inserted, so that four or more spring fingers 1412 are preferred. The depth to which the spring finger slots 1410 are cut is slightly longer than the maximum mating depth of the plug's outer contact 52 into the jack's outer contact 14 to allow maximum mating depth to be achieved without plastically deforming the jack's outer contact 14. Therefore, it is desirable that the spring finger slots 1410 not be cut substantially into the large OD region 1407, because doing so could force an undesirable expansion of the OD region's 1407 diameter when the jack 10 and plug 50 are fully mated, which in turn could cause undesirable contact between the front housing 14 and outer sleeve 12.

In the case of coaxial connections where the ability to retain the connection against a tensile load is desired, detents (not shown) on the ID of the outer contact 1406 of the jack 10 snap onto a raised rim (not shown) at the front OD of the plug coax outer contact (housing) 52 or by an additional latching method such as an external snap ring (not shown). Detents and raised rims are not used in multi-pin applications with external coupling means.

The outer contact 14 can be made of Beryllium Copper Alloy UNS-C17300, temper TD04 or TD02 per ASTM-B-196/197, or any suitable metal having high conductivity, good machining traits, and which is heat treatable and easily plated.

Jack Spring

FIG. 12

Figure 12:
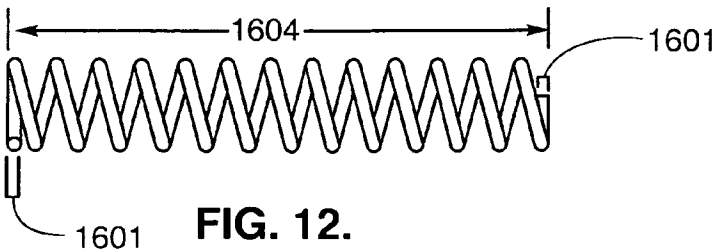
FIG. 12 is a side view of the jack spring.
Figure 12A:
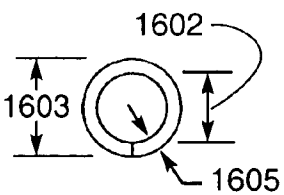
FIG. 12A is an axial end view of the jack spring.

FIGS. 12 and 12A illustrate the coil spring 16 and its features. By pushing against the small-diameter ID region 124 of the outer sleeve 12 and the large-diameter OD region 1407 of the outer contact 14 in a preloaded condition, the spring 16 forces the outer contact 14 toward the front of the jack assembly 10. When the jack 10 and plug 50 are fully mated, the spring is further compressed as the outer contact 14 slides toward the rear of the jack assembly 10. By remaining in compression, the spring 16 helps to ensure that the outer contacts 52, 14 and the center contacts 28, 54 are held in a butt-mated condition when the assemblies 10, 50 are mated.

The coil spring 16 is designed with closed ends 1601 that are constrained in the axial direction by features (1407, 124) in the jack's front housing 14 at one end, and the outer sleeve 12 at the other. The use of closed ends 1601, as opposed to open ends, helps to even the load distribution around the circumference of the constraining features (1407, 124) on both the front housing 14 and the outer sleeve 12. The wire diameter 1605, coil OD 1603, and coil ID 1602 should be such that there is a clearance fit for the spring 16 between the outer surface of the front housing 1405 and the inner diameter of the outer sleeve 126. The coil spring 16 can be made of Stainless Steel Alloy 17-7PH or any other suitable high-strength spring metal with good corrosion resistance.

Jack Rear Housing

FIG. 13

FIGS. 13, 13A, 13B, & 13C illustrate the jack's rear housing 24. The rear housing 24 is in the shape of a hollow cylinder having various inner diameters and outer diameters along its length that create features for the purposes of interfacing between the outer sleeve 22, the outer contact 14, and the bushing 26. Beginning with FIG. 13, the OD features include a beveled edge 2413 that breaks the otherwise sharp edge. A constant-diameter OD region 2411 provides extra wall thickness for a swaging operation when assembling it to the bushing 26. A tapered OD region 2409 is also intended to facilitate assembly and a swaging operation, where the tapered OD region 2409 forms an interference fit with the ID region 122 of the jack outer sleeve 12. A narrower OD region 2407 follows and is sized to fit inside the ID region 122 of the jack outer sleeve 12. A constant-diameter OD region 2405 follows and has approximately the same OD dimension as the jack outer sleeve regions 121, 125, to create a smooth profile in the finished assembly. An expanding-diameter region 2403 meets with a beveled OD region 2401 at the end of the rear housing 24, breaking the edge of the expanding-diameter tapered region 2403 that is used as swaging material during assembly.

FIG. 13A depicts the cross-section along Line 13A in FIG. 13. A chamfered region 2402 eases assembly of the cable bushing 26 into the large ID region 2404 of the rear housing 24. A narrower ID region 2406 provides a stop for the bushing 26 and the rear bead ring 22. A larger ID region 2408 is sized to accommodate the jack's outer contact 14, with a chamfered region 2410 to facilitate assembly.

The rear housing 24 can be made of Beryllium Copper Alloy UNS-C17300, temper TD04 or TD02 per ASTM-B-196/197, or any suitable metal having high conductivity, good machining traits, and which is heat treatable and easily plated.

Jack Center Contact

FIG. 14

FIGS. 14 and 14A illustrate the jack center contact pin 28. The contact pin 28 is a solid cylinder of varied diameter, having three stepped-down regions (2803, 2807, 2811) and a slotted and hollowed end region 2801. First, the stepped-down front end 2811 is used when connecting with a PC board. In the case of a cable connection, the front end 2811 would instead have the same configuration as the hollow back end 2801 shown. The next step down region 2807 is designed to have the front bead 20 snapped into place at that location, and the remaining step down region 2803 is designed to have the rear bead 22 snapped into place at that location. A slot 2802 in the hollow rear section (see also FIG. 14A) allows for an interference fit when a male connector (not shown) is inserted. The contact pin diameters are designed to minimize reflections, losses, and to provide nearly-constant impedance along the length of the jack 10. The contact pin 28 can be made of Beryllium Copper Alloy UNS-C17300, temper TD04 or TD02 per ASTM-B-196/197, or any suitable metal having high conductivity, good machining traits, and which is heat treatable and easily plated.

Jack Cable Bushing

FIG. 15

FIGS. 15, 15A, and 15B illustrate the jack cable bushing 26. This bushing 26 is in the shape of a hollow cylinder having varying inner and outer diameter dimensions that are circumferentially constant. That is, any longitudinal section taken through the longitudinal axis will result in identical halves. The cable bushing 26 holds the rear bead ring 22 that in turn holds the center contact 54 in position. The cable bushing 26 is press fit into the front housing 52 and swaged into place. When assembled into the jack assembly 10, the cable bushing 26 constitutes the rearmost extremity of the jack assembly 10 and connects to coaxial cable. The front end of the cable bushing 26 has the same dimensional configuration as bushings designed for other applications such as the aforementioned PC board bushing.

The cable bushing has various features (2601, 2603, 2605, 2602, 2606, 2612) that are designed to meet the requirements of terminating a coaxial cable. Narrow OD region 2607 is designed to receive swage material from the wide OD regions 2401, 2403 of the jack's rear housing 24. The wider OD region 2609 and the tapered end 2611 fit closely within the ID region 2404 of the jack's rear housing 24. Referring now to FIG. 15A, the wide ID region 2610 is designed to receive the rear bead ring 22, and the narrowed region 2608 provides a stop for the rear bead ring 22.

The cable bushing 26 can be made of Beryllium Copper Alloy UNS-C17300, temper TD04 or TD02 per ASTM-B-196/197, or any suitable metal having high conductivity, good machining traits, and which is heat treatable and easily plated.

It will be obvious to those skilled in the art to make various changes, alterations and modifications to the invention described herein. To the extent such changes, alterations, and modifications do not depart from the spirit and scope of the appended claims, they are intended to be encompassed therein.

I claim:

1. A jack assembly for a coaxial connector cooperable with a mating plug comprising:

(a) an outer sleeve having a front end and a rear end, said front end having an alignment guide for receiving a mating plug;

(b) a generally tubular outer contact within said sleeve substantially concentric with said sleeve having at least one flexible member with an integral butt mating step in the inside diameter and an alignment member at the front end engageable with a mating plug, said outer sleeve and outer contact being in electrical contact;

(c) a contact pin concentric within said outer contact and defining an air gap with said outer contact, said contact pin being fixedly mounted in front and rear insulator mounting beads and having a connector at the front end mateable with a plug component;

(d) biasing means urging said outer contact toward the front end of the sleeve; and (e) a connector at the rear of the sleeve engaging the outer contact for interfacing with a transmission component.

2. The jack assembly of claim 1 wherein the alignment member is a bushing that is received in the front end of the outer sleeve.

3. The jack assembly of claim 2 wherein the bushing defines an opening that is chamfered to guide insertion of a mating plug.

4. The jack assembly of claim 1 wherein said flexible member comprises a spring finger defining a shoulder.

5. The jack assembly of claim 1 wherein the contact pin defines spaced-apart regions of reduced diameter.

6. The jack assembly of claim 5 wherein the rear end of the contact pin defines a region engageable with a transmission component.

7. The jack assembly of claim 6 wherein the region engageable with a transmission component is hollow having a single longitudinal slot therein.

8. A plug assembly for a coaxial connection cooperable with a jack comprising:

(a) a generally axially extending outer contact having a tubular front section of substantially uniform diameter receivable in a jack and terminating at a larger diameter stop at the rear end, the contact having an inner wall defining an abutment surface;

(b) a center contact pin disposed in front and rear insulator mounting beads within the tubular outer contact, said center contact pin defining a connector at the front end mateable with a jack component;

(c) said contact pin and outer contact defining an air gap therebetween; and (d) a connector at the rear end configured for connection to a transmission component.

9. The plug assembly of claim 8 wherein the tubular section smoothly transitions to the said larger diameter stop, said larger diameter stop section having a interior diameter greater than that of the tubular section and housing the rear insulator mounting.

10. The plug assembly of claim 8 wherein the center contact is a pin defining at least two spaced-apart areas of reduced diameter.

11. The plug assembly of claim 8 wherein the pin has hollow, single slotted rear and front ends.

12. The plug assembly of claim 9 wherein the front and rear insulator beads are in an interference fit with the inner diameter of the stop section.

13. The plug assembly of claim 9 wherein the front insulator mounting is a dielectric bead disposed about one of said areas of reduced diameter.

14. A coaxial connector comprising:

(a) a jack including:

(i) an outer sleeve having a front end and a rear end, said front end having an alignment guide for receiving a mating plug;

(ii) a generally tubular outer contact within said sleeve substantially concentric with said sleeve having at least one flexible member with an integral butt mating step in the inside diameter and an alignment member at the front end engageable with a mating plug, said outer sleeve and outer contact being in electrical contact;

(iii) a contact pin concentric within said outer contact and defining an air gap with said outer contact, said contact pin being fixedly mounted in front and rear insular mounting beads and having a connector at the front end mateable with a plug component;

(iv) biasing means urging said outer contact toward the front end of the sleeve;

(iv) a connector at the rear of the sleeve engaging the outer contact for interfacing with a transmission component and (b) a plug engageable in said jack having:

(i) a generally axially extending outer contact having a tubular front section receivable in a jack and a rear end, the contact having an inner wall defining an abutment surface;

(ii) a center contact pin disposed in front and rear insular mounting beads within the tubular outer contact, said center contact pin defining a connector at the front end mateable with a jack component;

(iii) said contact pin and outer contact defining an air gap therebetween; and (iv) a connector at the rear end configured for connection to a transmission component.

15. A jack assembly for a coaxial connection with a plug housing a pin having a mateable end, said jack assembly comprising:

(a) an outer sleeve having a front end and a rear end, said front end defining an alignment guide having a first alignment surface engaging the mateable end as the plug end is inserted into said jack assembly;

(b) a generally tubular outer contact within said sleeve substantially concentric with said sleeve having a spring finger with an end defining a second alignment surface engageable with the mateable end as the plug is advanced into said jack assembly and an integral butt mating step in the spring finger inside diameter defining an electrical reference plane;

(c) a contact pin concentric within said outer contact and defining an air gap with said outer contact, said contact being fixedly mounted in front and rear insulator mounting beads, said pin having an end defining a third alignment surface engageable with the plug contact pin as the plug is brought into mating engagement with the jack assembly;

(d) biasing means urging said outer contact toward the front end of the sleeve; and (e) a connector at the rear of the sleeve engaging the outer contact for interfacing with a transmission component.

16. The jack assembly of claim 15 wherein the air gap defines a dielectric extending substantially the length of the outer contact.

17. The jack assembly of claim 15 wherein a space is defined between the outer sleeve and said spring finger permitting limited radial flexure of said spring finger.

18. The jack assembly of claim 15 wherein the spring finger defines a shoulder on the inside diameter for engaging a plug in butt mating relationship.

* * * * *